US006520779B1

(12) United States Patent
Watanabe et al.

(10) Patent No.: US 6,520,779 B1
(45) Date of Patent: Feb. 18, 2003

(54) CIRCUIT MEMBER CONNECTION STRUCTURE

(75) Inventors: Hiroshi Watanabe, Shizuoka (JP); Akira Tsubaki, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/449,478

(22) Filed: Nov. 29, 1999

(30) Foreign Application Priority Data

Dec. 2, 1998 (JP) ..... 10-342532

(51) Int. Cl.[7] ..... H01R 9/09
(52) U.S. Cl. ..... 439/66; 439/630
(58) Field of Search ..... 439/66–72, 752, 439/630

(56) References Cited

U.S. PATENT DOCUMENTS

| | | | | |
|---|---|---|---|---|
| 3,307,139 A | | 2/1967 | Prise | |
| 3,613,049 A | | 10/1971 | Niedzwiecki | |
| 3,696,319 A | | 10/1972 | Olsson | |
| 5,199,889 A | * | 4/1993 | McDevitt, Jr. | 439/66 |
| 5,205,738 A | * | 4/1993 | Anderson, Jr. et al. | 439/66 |
| 5,362,247 A | * | 11/1994 | Rodriguez | 439/66 |
| 5,498,169 A | | 3/1996 | Ikemoto | 439/260 |
| 5,586,890 A | * | 12/1996 | Braun | 439/66 |
| 5,611,696 A | * | 3/1997 | Donner et al. | 439/66 |
| 5,967,797 A | * | 10/1999 | Maldonado | 439/66 |
| 5,997,315 A | * | 12/1999 | Akama et al. | 439/66 |
| 6,065,977 A | * | 5/2000 | Toda et al. | 439/66 |

FOREIGN PATENT DOCUMENTS

| | | |
|---|---|---|
| GB | 1 327 194 | 8/1973 |
| GB | 2 289 580 | 11/1995 |
| JP | 10-152000 | 6/1998 |

OTHER PUBLICATIONS

Becon Printed Circuit Connector Part No. 2802–01 Brown Engineering Company, Inc. (Bewn 180#single 10).*

* cited by examiner

*Primary Examiner*—Hien Vu
(74) *Attorney, Agent, or Firm*—Morgan, Lewis & Bockius LLP

(57) ABSTRACT

A connection structure comprises a first structure (1) includes a first window (9), a plurality of first circuit members (2) disposed in the first structure (1), the first circuit members (2) having first connection portions (3) exposed at the first window (9) of the first structure (1), a second structure (4) including a second window (11), a plurality of second circuit members (5) disposed in the second structure (4), the second circuit members (5) having second connection portions (6) exposed at the second window (11) of the second structure (4). An arrangement of the first connection portions (3) is different from an arrangement of the second connection portions (6). The connection structure further comprises a connector (7A) including a plurality of terminals (21) that electrically connect the first connection portions (3) with the second connection portions (6) and have first contact portions (30) and second contact portions (31). The first contact portions (30) are arranged correspondingly to the arrangement of the first connection portions (3) and electrically connected to the first connection portions (3), respectively, and the second contact portions (31) are arranged correspondingly to the arrangement of the second connection portions (6), and electrically connected to the second connection portions (6), respectively.

9 Claims, 13 Drawing Sheets

CIRCUIT MEMBER CONNECTION STRUCTURE

BACKGROUND OF THE INVENTION

1. Field of the Invention

The present invention relates to a circuit member connection structure used for electrically connecting second connection portions to first connection portions at a later stage.

The present application is based on Japanese Patent Application No. Hei. 10-342532, which is incorporated herein by reference.

2. Description of the Related Art

A wire harness is insert molded (or embedded) in a panel of an automobile, such as an instrument panel and a door panel. In some cases, an optional equipment (auxiliary equipment) is electrically connected to the wire harness at a later stage.

There has been proposed a connection structure used for connecting an equipment to a wire harness in Unexamined Japanese Patent Publication No. Hei. 10-152000.

As shown in FIG. 15, this connection structure includes a panel 80 having a wire harness 81 insert molded therein, a window 82 formed in the panel 80, wires (first connection portions) 83 of the wire harness 81 exposed at the window 82, and a wire holder 84 having press-connecting terminals 85. When the wire holder 84 is pressed into the window 82, the wires 83 are press-fitted in the press-connecting terminals 85, respectively. As a result, branch wires (second connection portions) 86, connected to the wire holder 85, are electrically connected respectively to the wires 83 of the wire harness 81.

However, the wires 83 are respectively connected to the branch wires 86 by the press-connecting terminals 85, and therefore there has been encountered a drawback in that the press-connecting terminals 85 can not flexibly meet various connection arrangements of the wires 83 and/or branch wires 86. Therefore, this has been dealt with by adjusting the position of formation of the window 82. However, this has increased the number of types of panels 80, and therefore has invited disadvantages in connection with the stock management and so on.

SUMMARY OF THE INVENTION

With the above problems in view, it is an object of the present invention to provide a circuit member connection structure in which an electrical connection can be made while flexibly meeting an arrangement of first and second connection portions, without increasing the number of types of panels.

To achieve the above object, according to the first aspect of the present invention, there is provided a connection structure which comprises a first structure, a plurality of first circuit members disposed in the first structure, the first circuit members having first connection portions exposed from the first structure, a second structure, a plurality of second circuit members disposed in the second structure, the second circuit members having second connection portions exposed from the second structure, wherein an arrangement of the first connection portions is different from an arrangement of the second connection portions, and a connector including a plurality of terminals that electrically connect the first connection portions with the second connection portions, respectively, and have first contact portions and second contact portions, wherein the first contact portions of the terminals are arranged correspondingly to the arrangement of the first connection portions and electrically connected to the first connection portions, respectively, and the second contact portions of the terminals are arranged correspondingly to the arrangement of the second connection portions, and electrically connected to the second connection portions, respectively. Although the arrangement of the first connection portions is different from the arrangement of the second connection portions in the above-described connection structure, the present invention is not limited to this construction. For example, it is also possible to design the connection structure in which the arrangements of the first connection portions are substantially the same as the arrangements of the second connection portions.

According to the second aspect of the present invention depending upon the first aspect, it is preferable that the first structure includes a first window, the first connection portions are exposed at the first window of the first structure, and the second structure includes a second window, the second connection portions are exposed at the second window of the second structure.

According to the third aspect of the present invention depending upon the first or second aspect, it is preferable that the connection structure further comprises a retaining mechanism wherein the connector is retained on the first structure by the retaining mechanism.

According to the fourth aspect of the present invention depending upon the first aspect, it is preferable that the connector includes a housing body having first and second side walls opposed to each other, the first side wall having first terminal holes formed therein, and the second side wall having second terminal holes formed therein, and a plurality of terminal receiving chambers into which the terminals are respectively inserted, formed in the housing body, the terminal receiving chambers communicating with the first terminal holes and the second terminal holes, respectively, wherein the first contact portions of the terminals are respectively received in the first terminal holes, and the second contact portions of the terminals are respectively received in the second terminal holes.

According to the fifth aspect of the present invention depending upon the fourth aspect, it is preferable that the first terminal holes are so arranged that the arrangement of the first contact portions of the terminals corresponds to the arrangement of the first connection portions, and the second terminal holes are so arranged that the arrangement of the second contact portions of the terminals corresponds to the arrangement of the second connection portions.

According to the sixth aspect of the present invention depending upon the third aspect, it is preferable that the retaining mechanism includes an upstanding lock arm formed on at least one of opposite side walls of the housing body, and extending toward the first structure, a lock projection formed on a free end of the lock arm, an arm groove formed in a peripheral portion of the first window so as to receive the lock arm, and a retaining groove which is formed in a surface of the arm groove so as to engage the lock projection.

According to the seventh aspect of the present invention depending upon the first aspect, it is preferable that the terminals include at least one first relay terminal which has a base plate portion, and first and second resilient contact portions which are extended respectively from opposite ends of the base plate portion, the first resilient contact portion has one of the first contact portions, and the second resilient contact portion has one of the second contact portions, and wherein length of the base plate portion is so designed that the first resilient contact portion is electrically connected to corresponding one of the first connection portions, and the second resilient contact portion is electrically connected to corresponding one of the second connection portions.

According to the eighth aspect of the present invention depending upon the seventh aspect, it is preferable that the first relay terminal has a substantially S-shaped cross-section.

According to the ninth aspect of the present invention depending upon the first aspect, it is preferable that the terminals include at least one second relay terminal which has a base plate portion, a pair of resilient holding portions extended from one of opposite sides of the base plate portion, the pair of resilient holding portions having one of the first contact portions, and a resilient contact portion extended from the other one of the opposite sides of the base plate portion, the resilient contact portion having one of the second contact portions, and wherein length of the base plate portion is so designed that the pair of resilient holding portions are electrically connected to corresponding one of the first connection portions, and the resilient contact portion is electrically connected to corresponding one of the second connection portions.

According to the tenth aspect of the present invention depending upon the first aspect, it is preferable that the terminals include at least one third relay terminal which has a base plate portion, an interconnecting plate portion having an L-shape, the interconnecting plate portion being extended from one end of the base plate portion, and cooperating with the base plate portion to form a U-shape, a resilient contact portion extended from one of opposite sides of the base plate portion, the resilient contact portion having one of the second contact portions, and a pair of resilient holding portions extended from one of opposite sides of the interconnecting plate portion, the pair of resilient holding portions having one of the first contact portions, and wherein length of at least one of the base plate portion and the interconnecting plate portion is so designed that the resilient contact portion is electrically connected to corresponding one of the second connection portions, and the pair of resilient holding portions are electrically connected to corresponding one of the first connection portions.

According to the eleventh aspect of the present invention depending upon the tenth aspect, it is preferable that the interconnecting plate portion has a transverse plate disposed perpendicular to the base plate portion, and a longitudinal plate disposed in parallel to the base plate portion, and the transverse and longitudinal plates are so designed that a position of insertion of the third relay terminal relative to the terminal receiving chamber can be changed.

According to the twelfth aspect of the present invention depending upon the eleventh aspect, it is preferable that the connection structure further comprises retaining lances provided in the terminal receiving chambers in a substantially comb-like fashion, the retaining lances including short lances and a long lance, wherein the base plate portion and the longitudinal plate of the third relay terminal are retained by the short lances, and the transverse plate is retained by the long lance.

According to the thirteenth aspect of the present invention depending upon the fourth aspect, it is preferable that the connection structure further comprises retaining lances provided in the terminal receiving chambers in a substantially comb-like fashion, wherein the terminals are respectively retained by the retaining lances.

According to the fourteenth aspect of the present invention depending upon the fourth aspect, it is preferable that the first and second contact portions are electrically connected to the first and second connection portions respectively through the first and second terminal holes.

DETAILED DESCRIPTION OF THE PREFERRED EMBODIMENTS

Preferred embodiments of the present invention will now be described with reference to FIGS. 1 to 14 and 16.

First Embodiment

FIGS. 1 to 4 show a first embodiment of a circuit member connection structure of the present invention.

Figure 1:
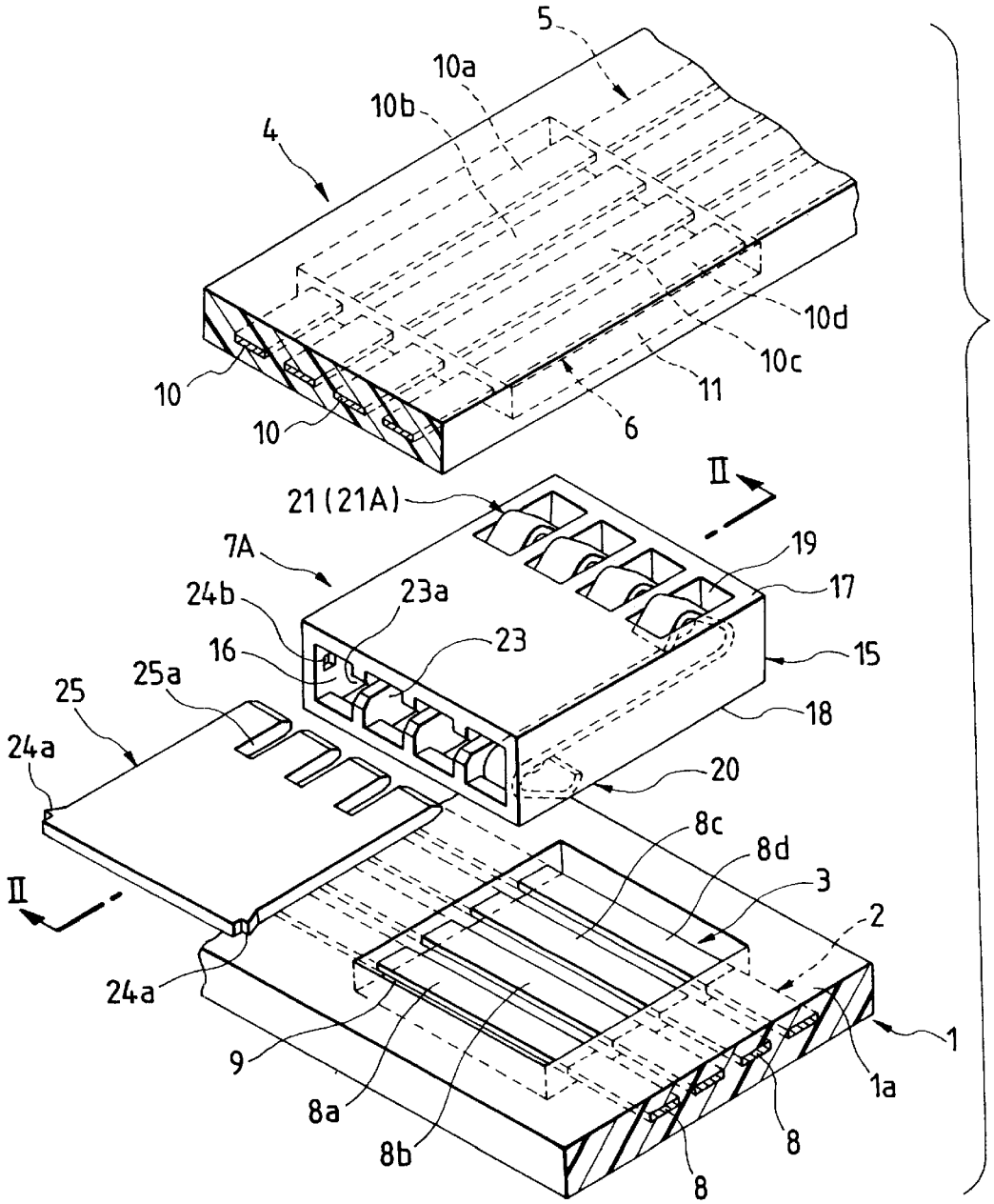
FIG. 1 is an exploded, perspective view showing a first embodiment of a circuit member connection structure of the present invention.

As shown in FIG. 1, in this connection structure, connection portions 3 of a circuit member 2 are electrically connected to equipment-side connection portions 6 of an equipment-side circuit member 5 by a connector 7A.

Examples of the circuit member 2 include a wire harness, a flat cable, a flat harness and a plurality of bus bars, insert molded (or embedded) in a panel 1 of a vehicle such as an instrument panel and a door panel. In this embodiment, the circuit member 2 comprises a plurality of panel-side bus bars 8, and opposite sides (surfaces) of the panel-side bus bars 8 are parallel to an upper surface 1*a* of the panel 1. In the case of a bundle of wires (not shown) forming a wire harness, an almost similar construction is provided.

The connection portions 3 are defined respectively by those portions of the panel-side bus bars 8 exposed at a panel-side window 9 formed in the panel 1. The four panel-side bus bars 8 are arranged in a juxtaposed manner in the panel-side window 9.

Examples of the equipment-side circuit member 5 include a wire harness, a flat cable, a flat harness and a plurality of bus bars, inserted molded (or embedded) in another panel 4. In this embodiment, although the equipment-side circuit member 5 comprises a plurality of equipment-side bus bars 10, a similar construction is provided even if any other equipment-side circuit member is used. The panel 4 is, for example, an instrument panel, a door panel, a door trim or a roof trim.

The equipment-side connection portions 6 are defined respectively by those portions of the equipment-side bus bars 10 exposed at an equipment-side window 11 open to one side of the panel 4. The four equipment-side bus bars 10 are arranged in a juxtaposed manner in the equipment-side window 11. In this embodiment, the direction of arrangement of the panel-side bus bars 8, exposed at the panel-side window 9, is perpendicular to the direction of arrangement of the equipment-side bus bars 10 exposed at the equipment-side window 11. The bus bars 8, as well as the bus bars 10, are arranged parallel to one another.

Figure 2:
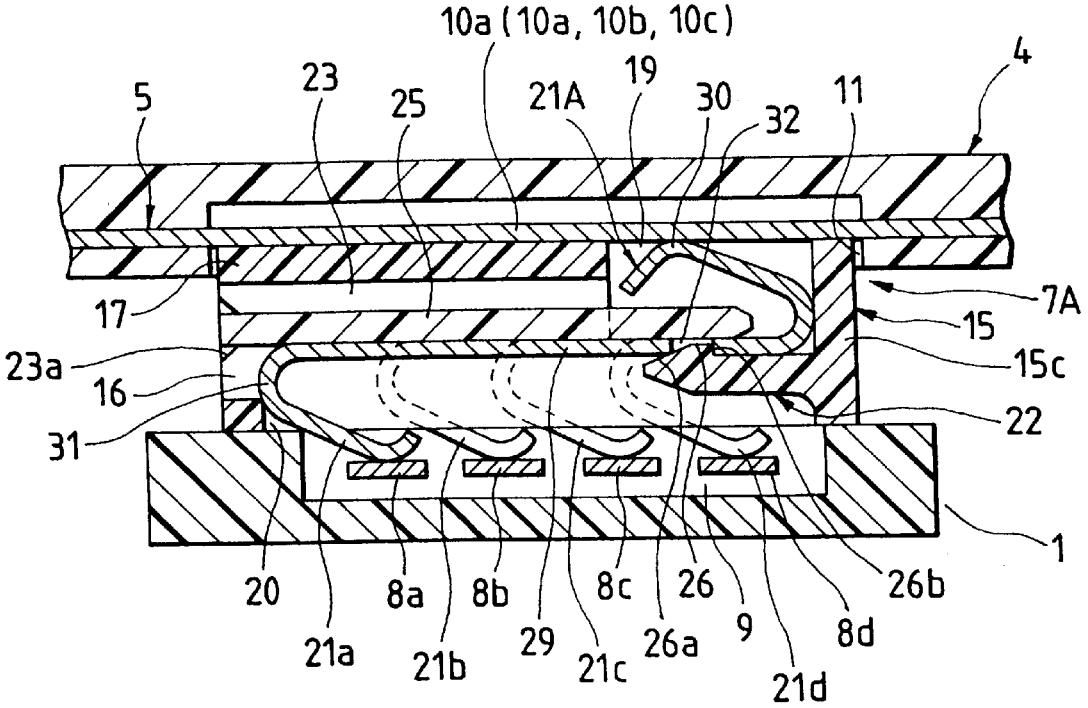
FIG. 2 is a cross-sectional view of the connection structure taken along the line II—II of FIG. 1.

As shown in FIGS. 1 and 2, the connector 7A includes a housing body 15 of an insulative nature, a plurality of terminal receiving chambers 16 formed in the housing body 15, upper terminal holes 19 formed through an upper wall 17 of the housing body 15, lower terminal holes 20 formed through a lower wall 18 of the housing body 15, and a terminal 21 received respectively in the terminal receiving chambers 16.

The upper terminal holes 19 are opposed to the equipment-side window 11, and the lower terminal holes 20 are opposed to the panel-side window 9.

The connector 7A may be fitted in the panel-side window 9 and the equipment-side window 11, or may be fixed relative to the panel-side window 9 and the equipment-side window 11 by a retaining mechanism.

The terminal receiving chambers 16 are arranged in a direction which is perpendicular to the direction of arrangement of the bus bars in the panel-side window 9, and is parallel to the direction of arrangement of the bus bars in the equipment-side window 11. A retaining lance 22 for retaining the terminal 21 is integrally formed within each terminal receiving chamber 16. The four upper terminal holes 19 are formed through the upper wall 17 in parallel relation to one another. The four lower terminal holes 20 are formed through the lower wall 18 in parallel relation to one another. A partition wall 23 is provided between any two adjacent upper terminal holes 19, and extends in a direction of insertion of the terminal 21 into the terminal receiving chamber 16.

The upper terminal hole 19 and the lower terminal hole 20 are provided for each terminal receiving chamber 16, and communicates with each other via the terminal receiving chamber 16. A notch 23*a* is formed in each partition wall 23, and a separate terminal holder 25 is inserted in the notches 23*a* formed respectively in the partition walls 23. The terminal holder 25 is in the form of a flat plate, and has slits 25*a* formed in a distal end portion thereof, and engagement projections 24*a* are formed respectively on opposite side edges of the terminal holder 25. Engagement holes 24*b* for respectively receiving the engagement projections 24*a* are formed respectively in inner surfaces of the terminal receiving chambers 16. The terminal holder 25 and the retaining lances 22 prevent the terminals 21 from being displaced out of position.

Each retaining lance 22 extends from a front wall 15*c* of the housing body 15, and underlies the corresponding upper terminal hole 19. An upwardly-directed retaining projection 26 is formed on a free end of the retaining lance 22. The retaining projection 26 has a slanting surface 26*a* and a stopper surface 26*b*. The slanting surface 26*a* facilitates the insertion of the terminal 21 into the terminal receiving chamber 16. The stopper surface 26*b* prevents the rearward withdrawal of the inserted terminal 21.

Figure 3:
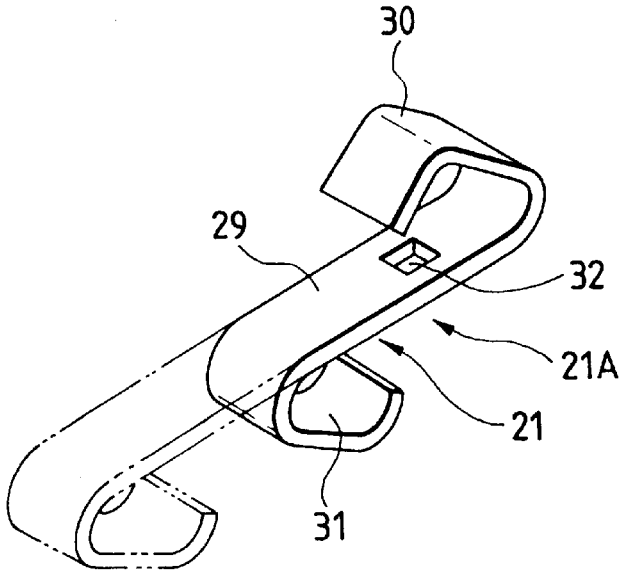
FIG. 3 is an enlarged perspective view of a terminal in FIG. 1.

As shown in FIGS. 2 and 3, the terminal 21 may be a first relay terminal 21A which includes a strip-like base plate portion 29, and upper and lower resilient contact portions 30 and 31 extending respectively from opposite ends of the base plate portion 29.

The base plate 29 is designed into desired length. In order that the upper and lower resilient contact portions 30 and 31 can have resiliency, the upper resilient contact portion 30 extends upwardly from one end of the base plate portion 29 in a curved manner whereas the lower resilient contact portion 31 extends from the other end of the base plate portion 29 in a curved or bent manner. Therefore, the first relay terminal 21A has a substantially S-shaped cross-section. A retaining hole 32 for the retaining projection 26 is formed through the base plate portion 29. By changing the base plate portion 29 of the first relay terminal 21A into necessary length, the positions of connection between the circuit member 2 and the equipment-side circuit member 5 can be easily changed to desired positions.

Next, with reference to FIGS. 1 and 2, explanation will be made of the case where the panel-side bus bars 8, exposed at the panel-side window 9, are electrically connected respectively to the equipment-side bus bars 10, exposed at the equipment-side window 11, at different connecting positions.

As shown in FIG. 1, the connecting positions are so determined that the first panel-side bus bar 8*a* is connected to the fourth equipment-side bus bar 10*d*, the second panel-side bus bar 8*b* is connected to the first equipment-side bus bar 10*a*, the third panel-side bus bar 8*c* is connected to the third equipment-side bus bar 10*c*, and the fourth panel-side bus bar 8*d* is connected to the second equipment-side bus bar 10*b*.

In order to achieve the above arrangement, four kinds of first relay terminals 21*a*, 21*b*, 21*c* and 21*d* are prepared by changing the length of the base plate portion 29 of the first relay terminal 21A, as shown in FIG. 2. The first relay terminals 21*a*, 21*b*, 21*c* and 21*d* are inserted respectively into the terminal receiving chambers 16, and are retained respectively by the retaining lances 22. As a result, there can be provided the connector 7A of a desired configuration.

Thus, merely by changing the length of the base plate portion 29, the arrangement of the first relay terminals 21A can be arbitrarily changed, and therefore there can be provided the connector 7A corresponding to a desired circuit. Therefore, in contrast with the related construction, there is no need to beforehand prepare many kinds of panels 1 (shown in FIG. 1) in accordance with variations of the connecting positions, and therefore the number of types of panels 1 can be reduced, and the stock management is easy.

Figure 4:
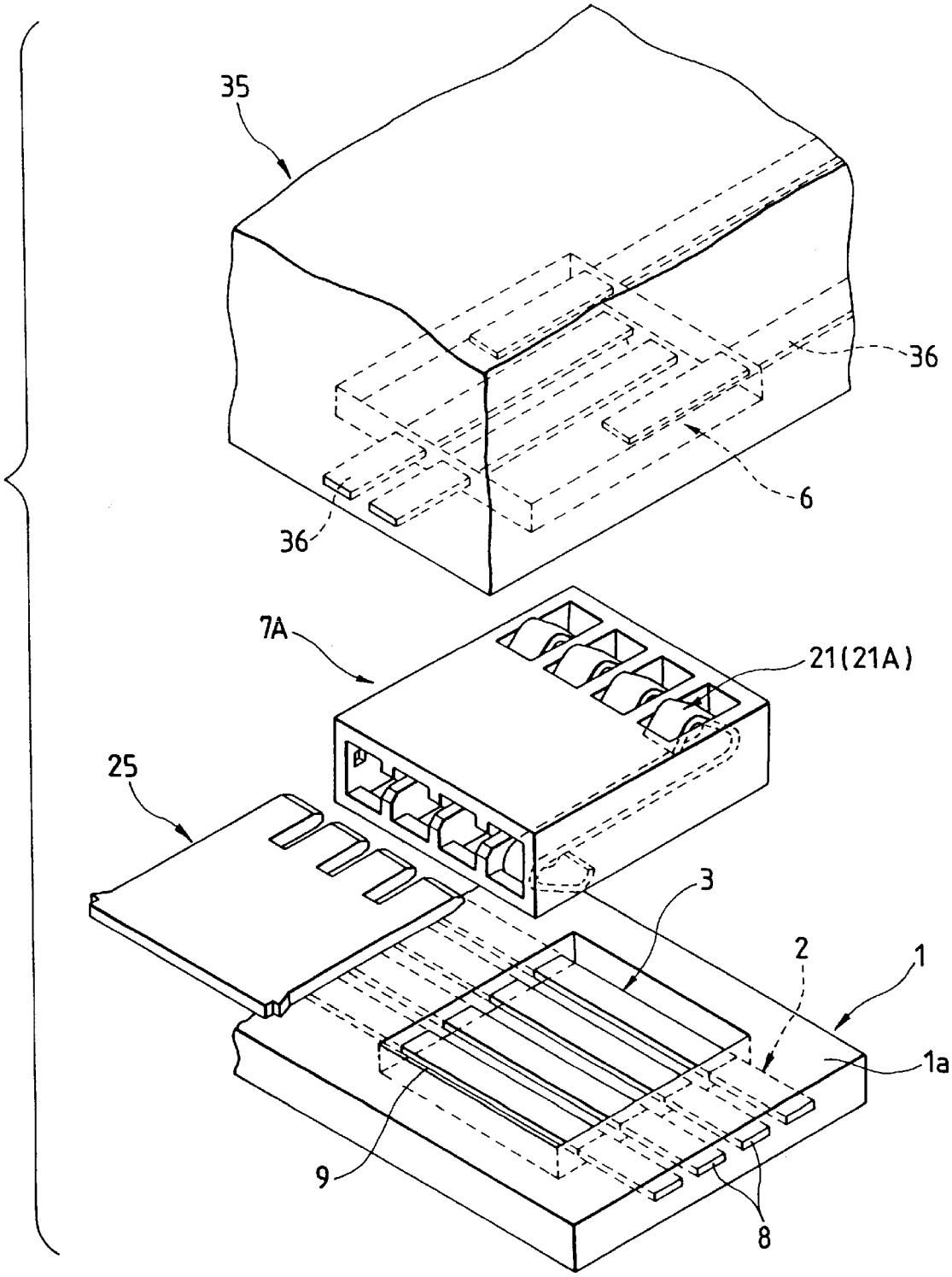
FIG. 4 is an exploded, perspective view showing a connection structure different from that of FIG. 1 in that a second circuit member is provided in an auxiliary equipment.

An almost similar construction is provided if an equipment-side circuit member 5 is mounted in an auxiliary equipment 35 as shown in FIG. 4. Also, an almost similar construction is provided if the circuit member 2 is mounted on the upper surface la of the panel 1, and therefore explanation thereof will be omitted. In this case, the panel-side window 9 does not need to be formed. Therefore, in this case, the connector 7A may be fixed to the upper surface 1*a* of the panel by a retaining mechanism or the like.

Figure 1A:
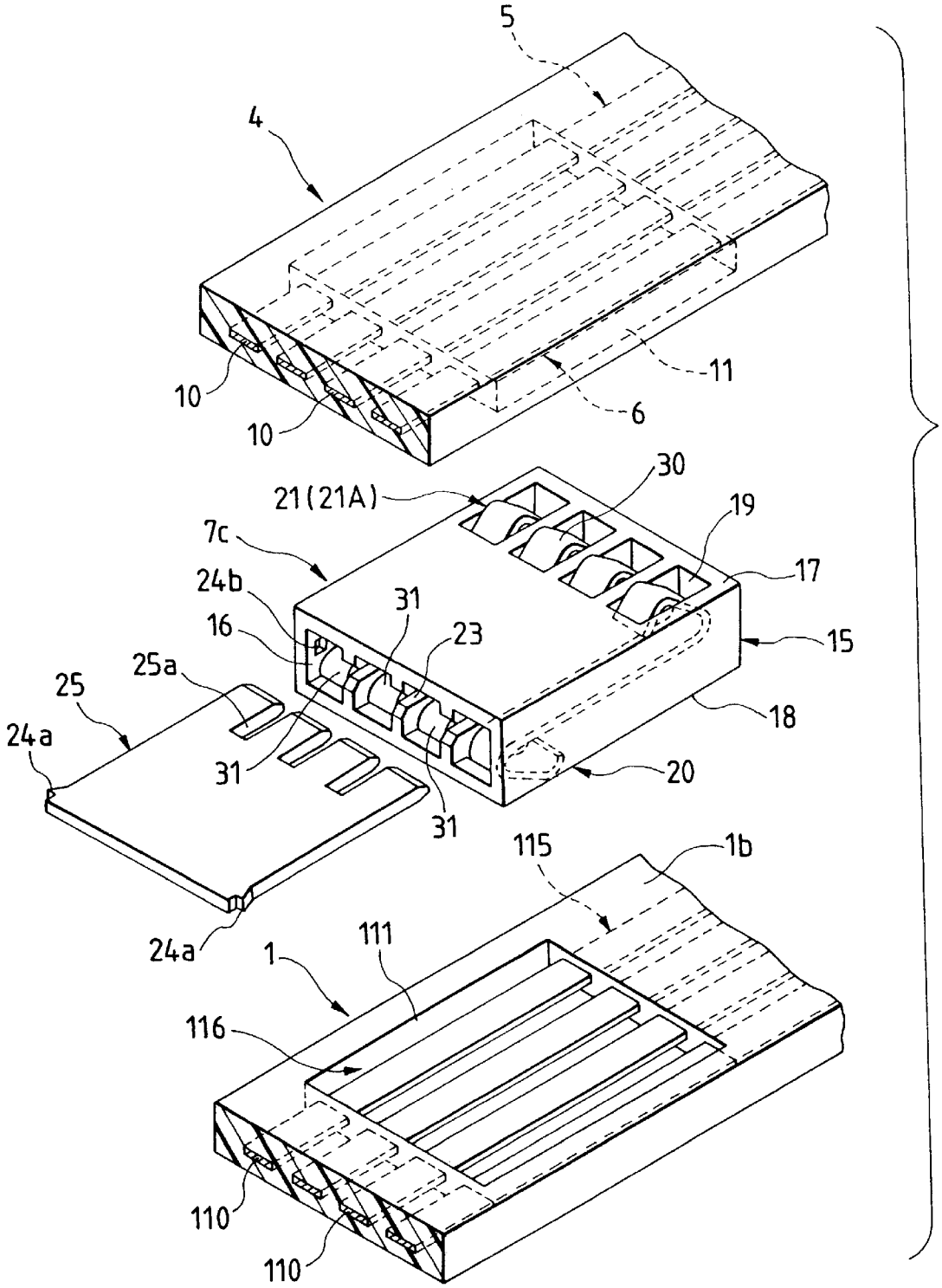
FIG. 1A is an exploded, perspective view showing a modified example of the first embodiment of the circuit member connection structure.

Incidentally, FIG. 1A shows a modified example of the above first embodiment of the circuit member connection structure. In this modified example, constituent members identical to those of the first embodiment will be designated by identical names and reference numerals, and detailed explanation thereof will be omitted.

In this connection structure, connection portions 116 of circuit members 115 are electrically connected to connection portions 6 of equipment-side circuit members 5 by a connector 7C.

The circuit member 115 comprises a plurality of panel-side bus bars 110, and opposite sides (surfaces) of each strip-like panel-side bus bar 110 are parallel to an upper surface 1*b* of the panel 1. The equipment-side circuit members 5 are defined by a plurality of equipment-side bus bars 10, respectively. In the modified example, the arrangements of the panel-side bus bars 110 are substantially similar to the arrangements of the equipment-side bus bars 10.

Accordingly, as shown in FIG. 1A, the connector 7C may include one kind of relay terminals 21A which are respectively received in the terminal receiving chambers 16. Of course, the connector 7A having the first relay terminals 21*a*, 21*b*, 21*c* and 21*d* shown in FIGS. 1 and 2 may be employed in this modified example instead of the connector 7C. The terminal receiving chambers 16 are so arranged that the directions of arrangements of the panel-side bus bars 110 (or the equipment-side bus bars 10) are the same as the direction of insertion of the terminals 21A.

Second Embodiment

FIGS. 5 to 14 show a second embodiment of a circuit member connection structure of the present invention. In this embodiment, constituent members identical to those of the first embodiment will be designated by identical names and reference numerals, and detailed explanation thereof will be omitted.

In this connection structure, connection portions 41 of circuit members 40 are electrically connected to connection portions 6 of equipment-side circuit members (optional circuit plates) 5 by a connector 7B.

In this embodiment, the circuit member 40 comprises a plurality of panel-side bus bars 42, and opposite sides (surfaces) of each strip-like panel-side bus bar 42 are perpendicular to an upper surface 1*a* of a panel 1. The optional circuit plates 5 are defined by a plurality of equipment-side bus bars 10, respectively. However, the directions of arrangements of the panel-side bus bars 42 and the directions of arrangements of the equipment-side bus bars 10 are the same.

Figure 5:
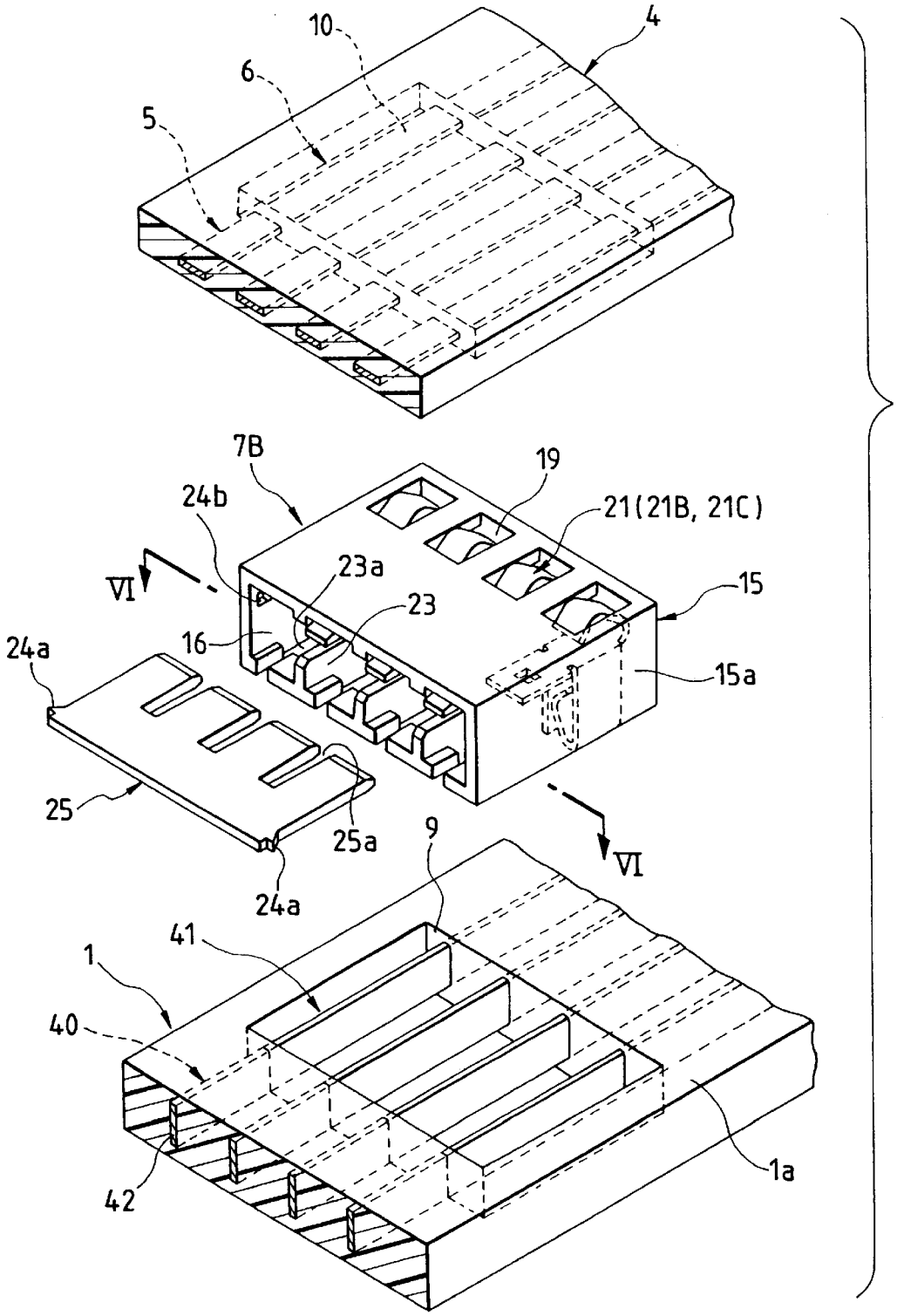
FIG. 5 is an exploded, perspective view showing a second embodiment of a circuit member connection structure of the present invention.
Figure 6:
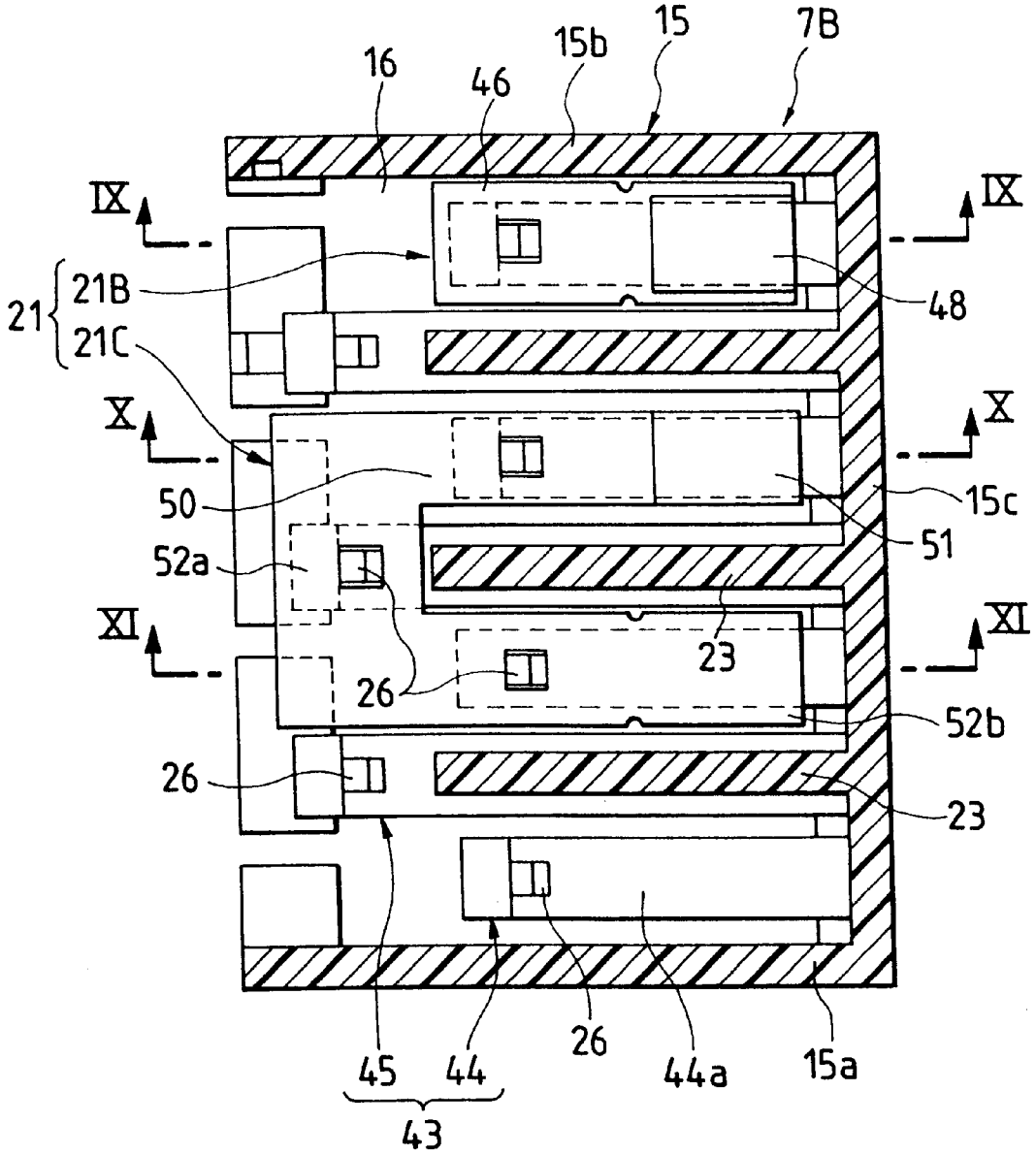
FIG. 6 is a cross-sectional view taken along the line VI—VI of FIG. 5.

As shown in FIGS. 5 and 6, the connector 7B includes a housing body 15 of an insulative nature, a plurality of terminal receiving chambers 16, upper terminal holes 19, lower terminal holes 20 (see FIG. 9), and two kinds of relay terminals (21) received in the terminal receiving chambers 16. The terminal receiving chambers 16 are so arranged that the directions of arrangements of the panel-side bus bars 42 (or the equipment-side bus bars 10) are the same as the direction of insertion of the terminals 21. Retaining lances 43 for retaining the terminals 21 are formed integrally within the terminal receiving chambers 16 in a substantially comb-like fashion.

The retaining lances 43 include short lances 44, which extend from a front wall 15*c* of the housing body 15, and underlie the upper terminal holes 19, respectively, and long lances 45 which extend from the front wall 15*c*, and underlie partition walls 23, respectively. The four short lances 44 are arranged in parallel relation between right and left side walls 15*a* and 15*b* of the housing body 15, and there are used the three long lances 45 each provided between any two adjacent short lances 44. An upwardly-directed retaining projection 26 is formed at a free end of each of the short and long lances 44 and 45. Incidentally, the retaining lances 22 of FIG. 2 can be replaced by the retaining lances 43, in which case the first relay terminals 21A (see FIG. 3) are retained by these retaining lances 43.

Figure 7:
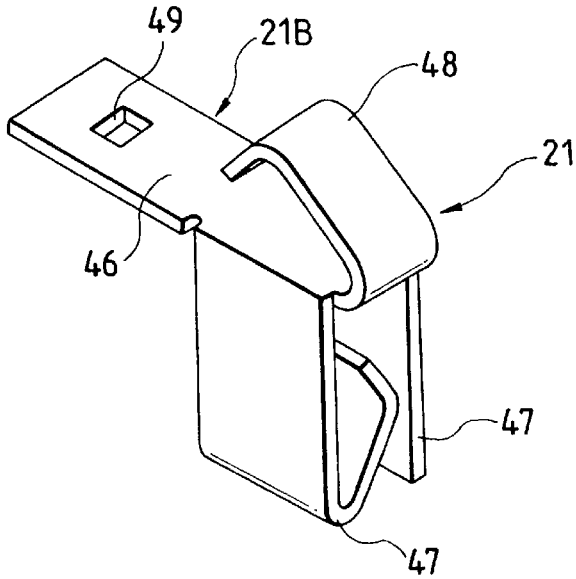
FIG. 7 is an enlarged perspective view of a terminal (second relay terminal) in FIG. 5.

As shown in FIGS. 5 and 7, the terminal 21 may be a second relay terminal 21B which includes a strip-like base plate portion 46, a pair of resilient holding portions 47 and 47 extending downwardly from a lower surface of the base plate portion 46, and a resilient contact portion 48 extending from one end of the base plate portion 46.

One of the pair of resilient holding portions 47 and 47 is longer than the other, and is inwardly bent into a substantially U-shaped cross-section. The panel-side bus bar 42 of the connection portion 41 is held between the pair of resilient holding portions 47 and 47. A retaining hole 49 for the retaining projection 26 (see FIG. 6) on the retaining lance 43 is formed through the other end portion of the base plate portion 46.

Figure 9:
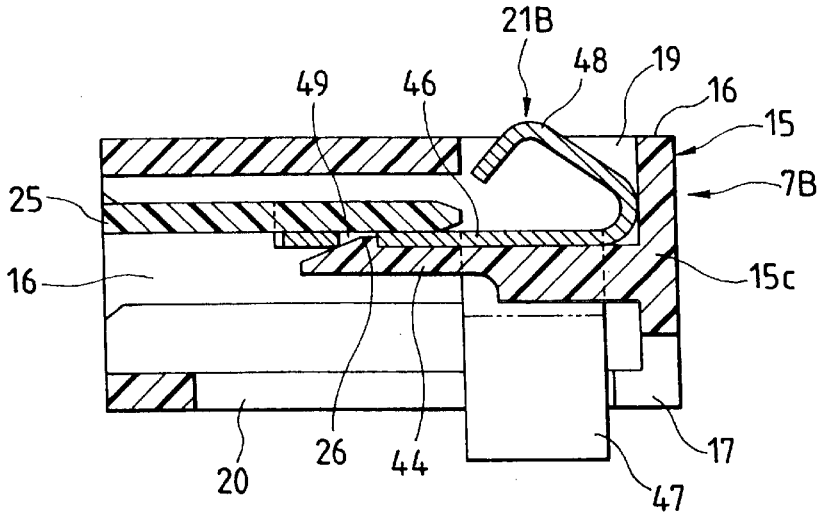
FIG. 9 is a cross-sectional view taken along the line IX—IX of FIG. 6.

As shown in FIG. 9, when the second relay terminal 21B is inserted into the housing body 15, an arm portion 44*a* (see FIG. 6) of the short lance 44 is received between the pair of resilient holding portions 47 and 47, and the retaining projection 26 is engaged in the retaining hole 49. At this time, the resilient contact portion 48 projects outwardly from the housing body through the upper terminal hole 19 while the pair of resilient holding portions 47 and 47 (see FIG. 7) project downwardly from the housing body through the lower terminal hole 20.

Figure 8:
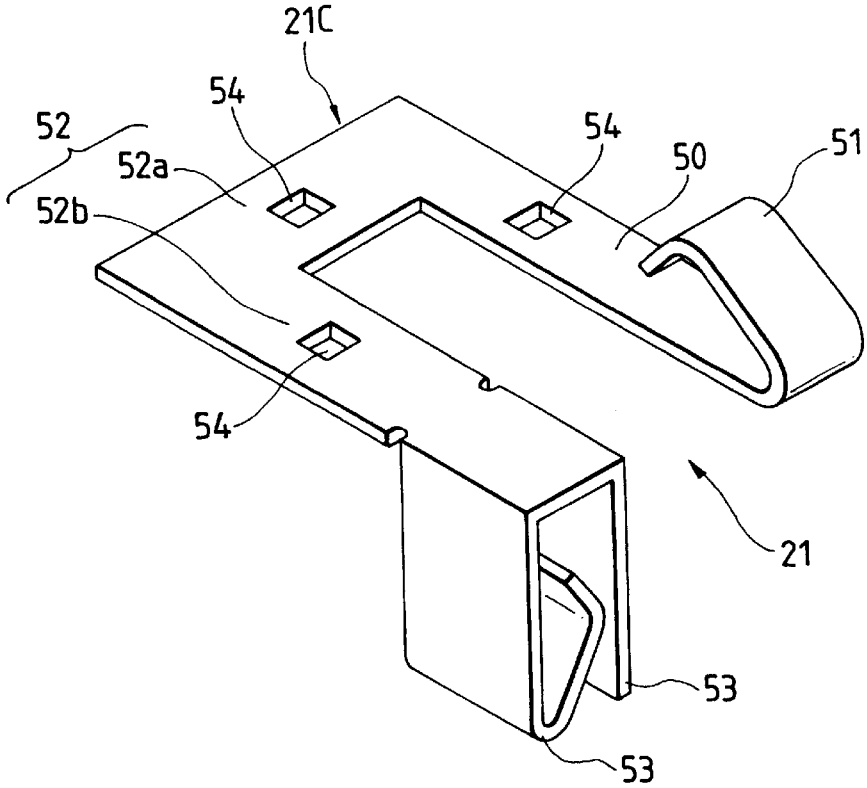
FIG. 8 is an enlarged perspective view of a terminal (third relay terminal) in FIG. 5.

As shown in FIGS. 5 and 8, the terminal 21 may be a third relay terminal 21C which includes a strip-like base plate portion 50, a resilient contact portion 51 extending from one end of the base plate portion 50, an interconnecting plate portion 52 formed integrally at the other end of the base plate portion 50, and a pair of resilient holding portions 53 and 53 extending downwardly from a lower surface of the interconnecting plate portion 52. The resilient contact portion 51 is identical in construction to the resilient contact portion 48 (see FIG. 7) of the second relay terminal 21B, and the resilient holding portions 53 are identical in construction to the resilient holding portions 47 (see FIG. 7) of the second relay terminal 21B. Since the interconnecting plate portion 52 has an substantially L-shape, the base plate portion 50 and the interconnecting plate portion 52, formed integrally with each other, jointly assume a substantially U-shape.

A transverse plate 52*a* and a longitudinal plate 52*b* of the interconnecting plate portion 52 are designed into desired length. The pair of resilient holding portions 53 and 53 extend from the lower surface of the longitudinal plate 52*b*. Therefore, by suitably changing the length of at least one of the transverse plate 52*a* and the longitudinal plate 52*b*, the connector can correspond to a desired circuit pattern. Retaining holes 54 for engagement with the retaining projections 26 (see FIG. 6) on the retaining lances 43 are formed through the base plate portion 50 and the interconnecting plate portion 52.

Figure 10:
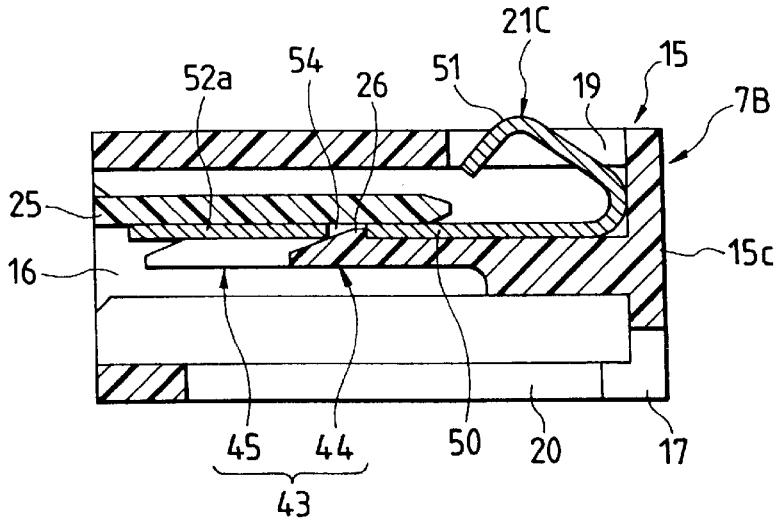
FIG. 10 is a cross-sectional view taken along the line X—X of FIG. 6.
Figure 11:
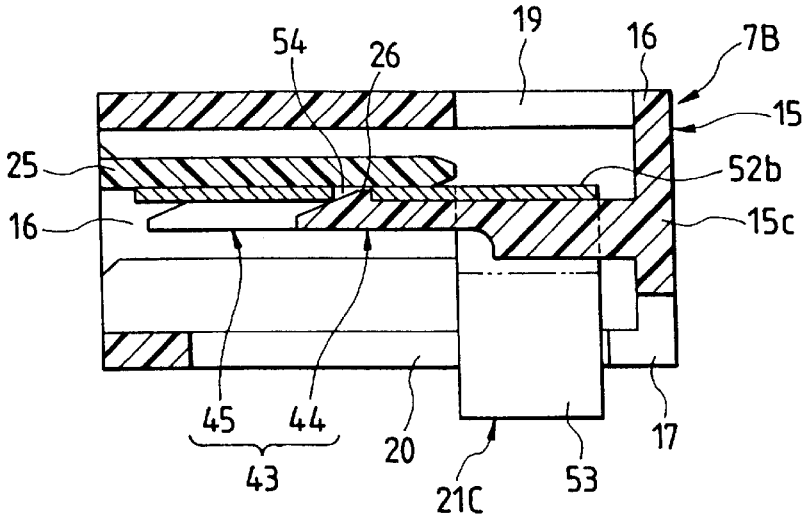
FIG. 11 is a cross-sectional view taken along the line XI—XI of FIG. 6.
Figure 12A:
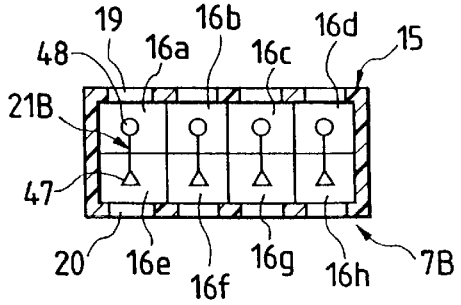
FIGS. 12(*a*) to (*h*) illustrate conditions in which a second relay terminal(s) and/or a third relay terminal(s) are inserted in terminal receiving chambers in a housing body, FIG. 12(*a*) showing the case of using four second relay terminals, FIG. 12(*b*) showing the case of using two second relay terminals and one third relay terminal, FIG. 12(*c*) showing the case of using one second relay terminal and one third relay terminal, FIG. 12(*d*) showing the case of using one third relay terminal, FIG. 12(*e*) showing the case of using two second relay terminals and one third relay terminal, FIG. 12(*f*) showing the case of using one second relay terminal and one third relay terminal, FIG. 12(*g*) showing the case of using two second relay terminals and one third relay terminal, and FIG. 12(*h*) showing the case of using two third relay terminals.
Figure 12B:
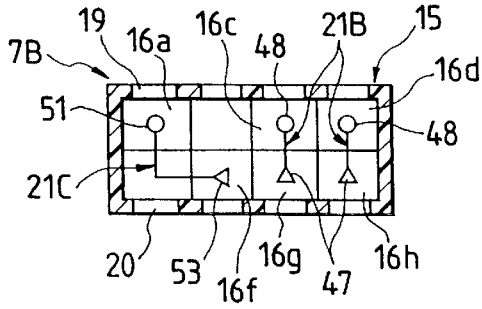
Figure 12C:
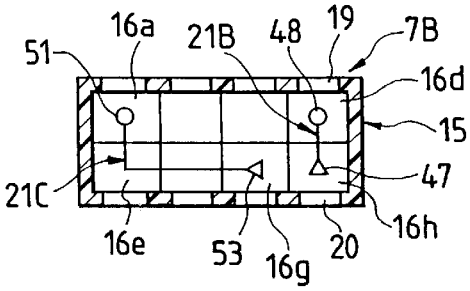
Figure 12D:
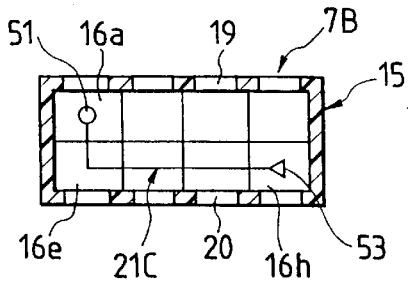
Figure 12E:
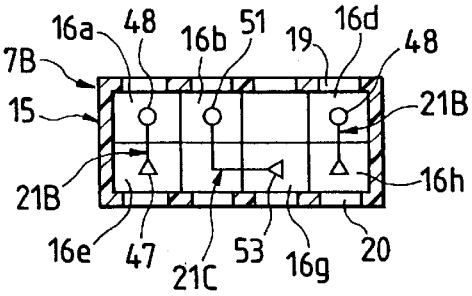
Figure 12F:
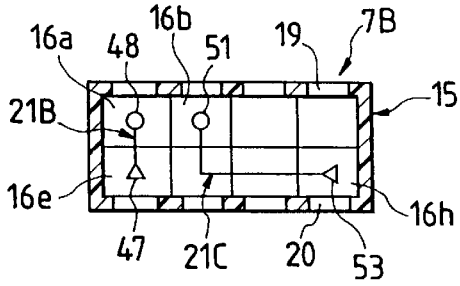
Figure 12G:
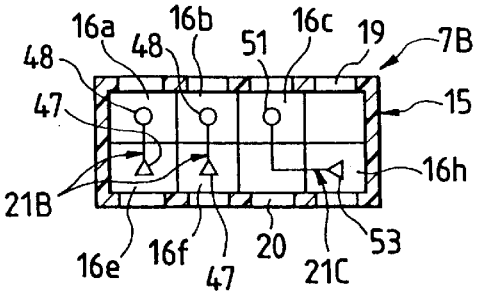
Figure 12H:
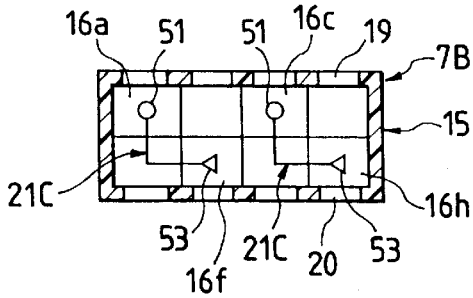

As shown in FIGS. 10 and 11, when the third relay terminal 21C is inserted into the terminal receiving chamber 16, the short lance 44 is received between the pair of resilient holding portions 53 and 53 (see FIG. 8). Therefore, the third relay terminal 21C is positively guided into the terminal receiving chamber 16. When the retaining projections 26 are engaged in the retaining holes 54, respectively, the resilient contact portion 51 projects outwardly from the housing body through the upper terminal hole 19 while the pair of resilient holding portions 53 and 53 are received in the lower terminal hole 20.

As shown in FIG. 12, for example, 8 kinds of combinations can be provided, using the second and third relay terminals 21B and 21C to be inserted into the housing body 15 of FIG. 5. Here, mark "○" represents the resilient contact portion 48 (51), mark "Δ" represents the resilient holding portions 47 of the second relay terminal 21B, mark "▽" represents the resilient holding portions 53 of the third relay terminal 21C, mark "–" represents the second relay terminal 21B, and mark "⌊" represents the third relay terminal 21C. Each of the terminal receiving chambers 16 is divided into upper and lower chambers, and the first upper chamber 16*a*, . . . and the fourth upper chamber 16*d* are arranged in this order from the left while the first lower chamber 16*e*, . . . and the fourth lower chamber 16*h* are arranged in this order from the left. The resilient contact portion 48 (51) is adapted to be received in the upper chambers 16*a* to 16*d*, and the pair of resilient holding portions 47 (53) are adapted to be received in the lower chambers 16*e* to 16*h*.

As shown in FIG. 12(*a*), four second relay terminals 21B are inserted respectively in the first upper and lower chambers 16*a* and 16*e* to the fourth upper and lower chambers 16*d* and 16*h*.

As shown in FIG. 12(*b*), two second relay terminals 21B are inserted respectively in the third upper and lower chambers 16*c* and 16*g* and the fourth upper and lower chambers 16*d* and 16*h*, and one third relay terminal 21C is inserted in the first upper chamber 16*a* and the second lower chamber 16*f*.

As shown in FIG. 12(*c*), one second relay terminal 21B is inserted in the fourth upper and lower chambers 16*d* and 16*h*, and one third relay terminal 21C is inserted in the first upper chamber 16*a* and the third lower chamber 16*g*.

As shown in FIG. 12(*d*), one third relay terminal 21C is inserted in the first upper chamber 16*a* and the fourth lower chamber 16*h*.

As shown in FIG. 12(*e*), two second relay terminals 21B are inserted respectively in the first upper and lower chambers 16*a* and 16*e* and the fourth upper and lower chambers 16*d* and 16*h*, and one third relay terminal 21C is inserted in the second upper chamber 16*b* and the third lower chamber 16*g*.

As shown in FIG. 12(*f*), one second relay terminal 21B is inserted in the first upper and lower chambers 16*a* and 16*e*, and one third relay terminal 21C is inserted in the second upper chamber 16*b* and the fourth lower chamber 16*h*.

As shown in FIG. 12(*g*), two second relay terminals 21B are inserted respectively in the first upper and lower chambers 16*a* and 16*e* and the second upper and lower chambers 16*b* and 16*f*, and one third relay terminal 21C is inserted in the third upper chamber 16*c* and the fourth lower chamber 16*h*.

As shown in FIG. 12(*h*), two third relay terminals 21C are inserted respectively in the first upper and second lower chambers 16*a* and 16*f* and the third upper and fourth lower chambers 16*c* and 16*h*.

As shown in FIG. 5, the second relay terminals 21B and the third relay terminal 21C are provided as shown in FIG. 5, and therefore only the second relay terminals 21B or only the third relay terminal(s) 21C can be inserted in the terminal receiving chambers 16 in the housing body 15, and alternatively a combination of second and third relay terminals 21B and 21C can be inserted in the terminal receiving chambers 16. Therefore, a combination of second and/or third relay terminals 21B, 21C can be adjusted in accordance with a pattern of connection between the first connection potions 41 and the second connection portions 6, and therefore the connecting positions of the terminals 21 in the connector 7B can be arbitrarily selected. Therefore, as compared with the related construction, the number of types of panels 1 can be reduced, and therefore the stock management of the panels 1 is easy.

And besides, as compared with the related construction, the circuit pattern of the first connection portions 41 and the second connection portions 6 can be easily changed with one connector 7B, and therefore the cost, involved in the connecting operation, can be reduced.

Figure 13:
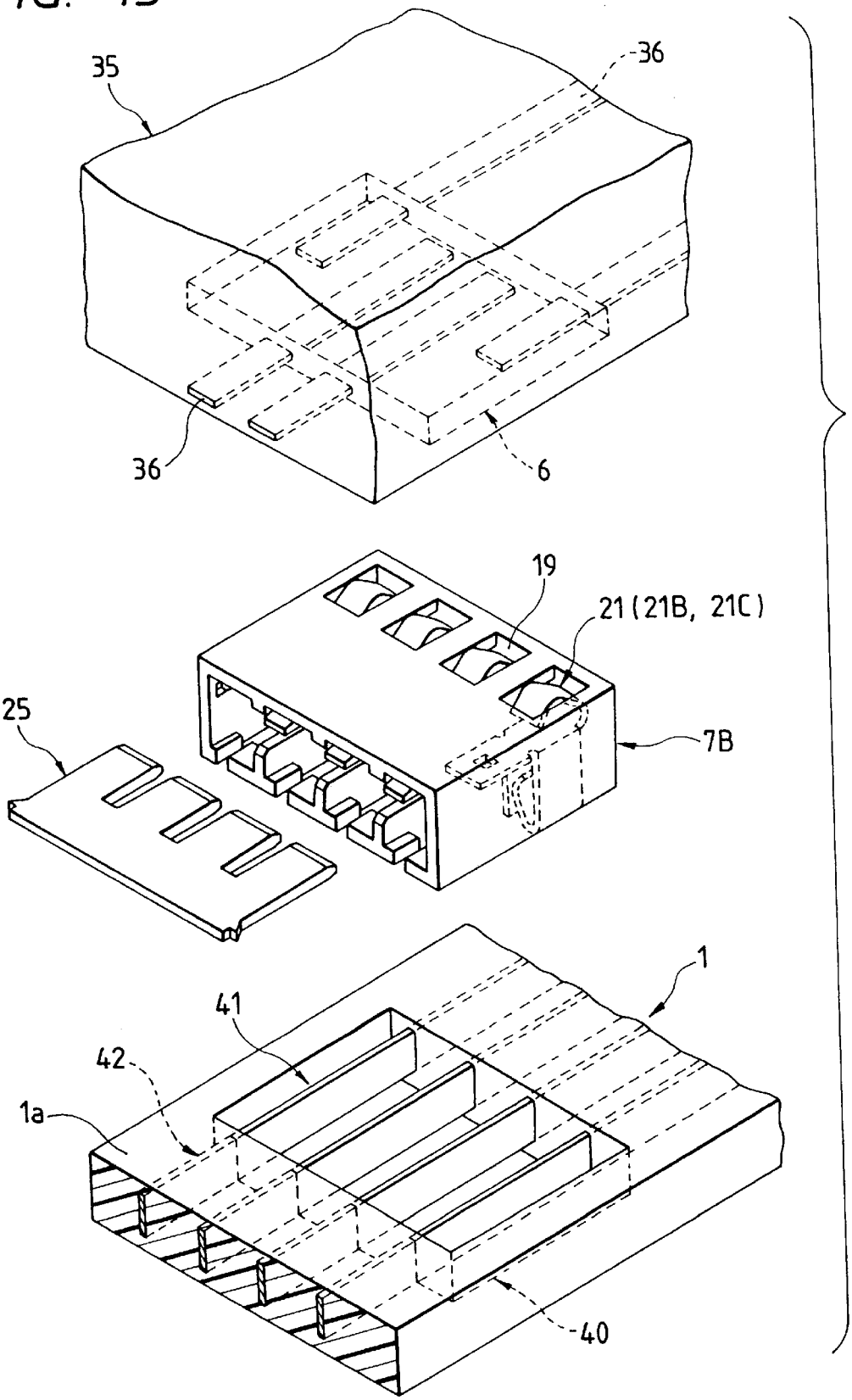
FIG. 13 is an exploded, perspective view showing a connection structure different from that of FIG. 5 in that a second circuit member is provided in an auxiliary equipment.

In the second embodiment, if a second circuit member 5 is mounted in an auxiliary equipment 35 as shown in FIG. 13, an almost similar construction is provided, and therefore explanation thereof will be omitted.

Figure 14:
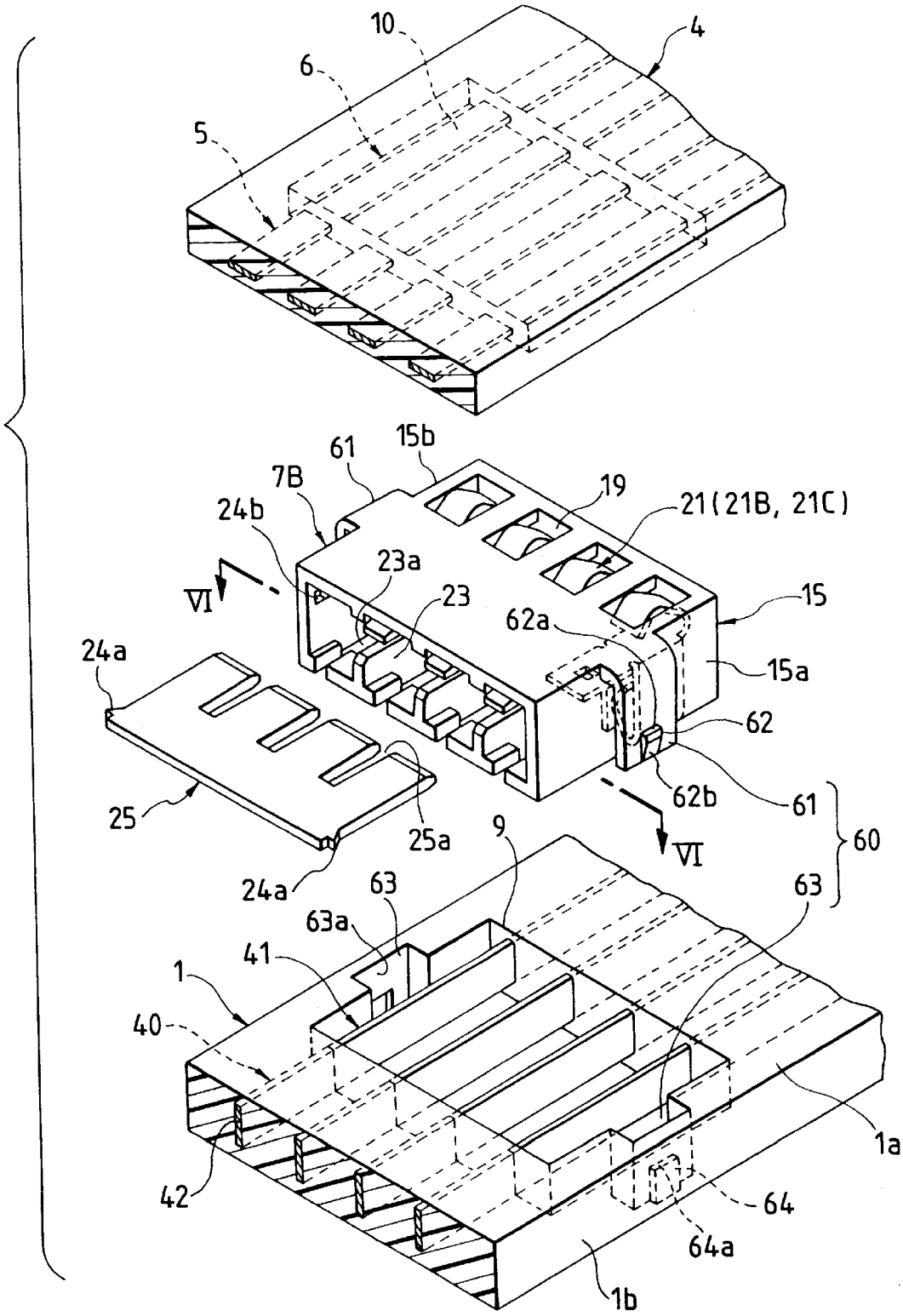
FIG. 14 is an exploded, perspective view showing retaining mechanism used in FIG. 5.
Figure 15:
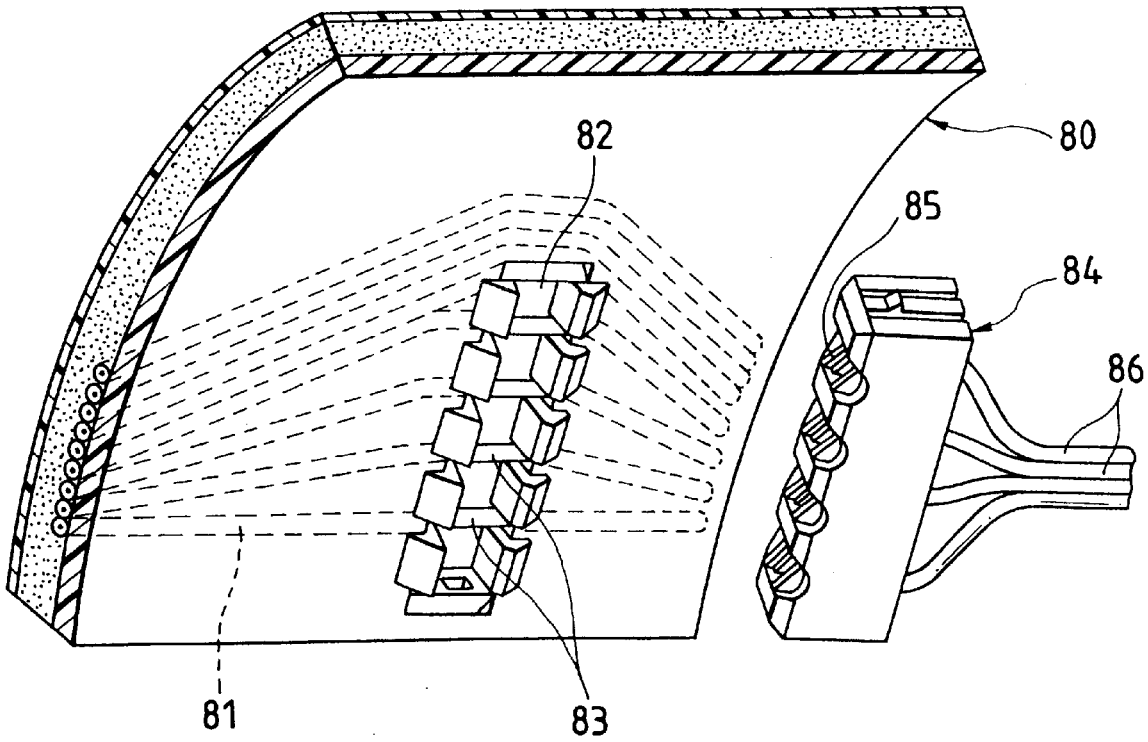
FIG. 15 PRIOR ART
FIG. 15 is a perspective view showing a related construction.

As shown in FIG. 14, the connector 7B can be engaged with the connection portions 41 by a retaining mechanism 60. The retaining mechanism 60 includes a pair of lock arms 61 and 61 formed respectively on the opposite side walls 15*a* and 15*b* of the housing body 15, lock projections 62 formed respectively at free ends of the lock arms 61 and 61, arm grooves 63 formed in a peripheral surface of the panel-side window 9, and retaining grooves 64 formed respectively in bottom surfaces of the arm grooves 63.

The pair of upstanding lock arms 61 and 61 extend straight respectively from upper portions of the opposite side walls 15*a* and 15*b* downwardly (that is, toward the connection portions 41), so that the lock arms 61 and 61 have elasticity. The lock projection 62 has a stopper surface 62*a* at its upper side, and a slanting surface 62*b* at its lower side. The arm groove 63 has such a size as to receive the lock arm 61. The retaining groove 64 of a channel-shaped cross-section is formed in the bottom surface 63*a* of the arm groove 63, and extends to the lower surface 1*b* of the panel 1.

For mechanically connecting the connector 7B to the connection portions 41, the connector 7B is pressed into the panel-side window 9, so that the lock arms 61 are inserted into the arm grooves 63, respectively. At this time, the lock projections 62 slide respectively on the bottom surfaces 63*a* of the arm grooves 63 while the lock arms 61 are elastically deformed inwardly (toward the connector). Simultaneously when the terminals 21 in the connector 7B are connected to the circuit member 40 in the panel-side window 9, the lock arms 61 are elastically restored, so that the lock projections 62 are inserted into the retaining grooves 64, respectively. The stopper surfaces 62*a* of the lock projections 62 are engaged with end surfaces 64*a* of the retaining grooves 64, respectively. As a result, the connector 7B is prevented from disengagement from the connection portions 41. The lock arms 61 are received in the arm grooves 63, respectively, and therefore the connector 7B can be positioned relative to the panel-side window 9.

In a modified form of the present invention, elastic lock projections or lock piece portions (not shown) can be formed directly on the opposite side walls 15*a* and 15*b* of the housing body 15. In this case, the arm grooves 63 are not formed in the peripheral surface of the panel-side window 9, and only retaining grooves 64 are formed, and therefore the retaining mechanism 60 can be simplified in construction.

Figure 16:
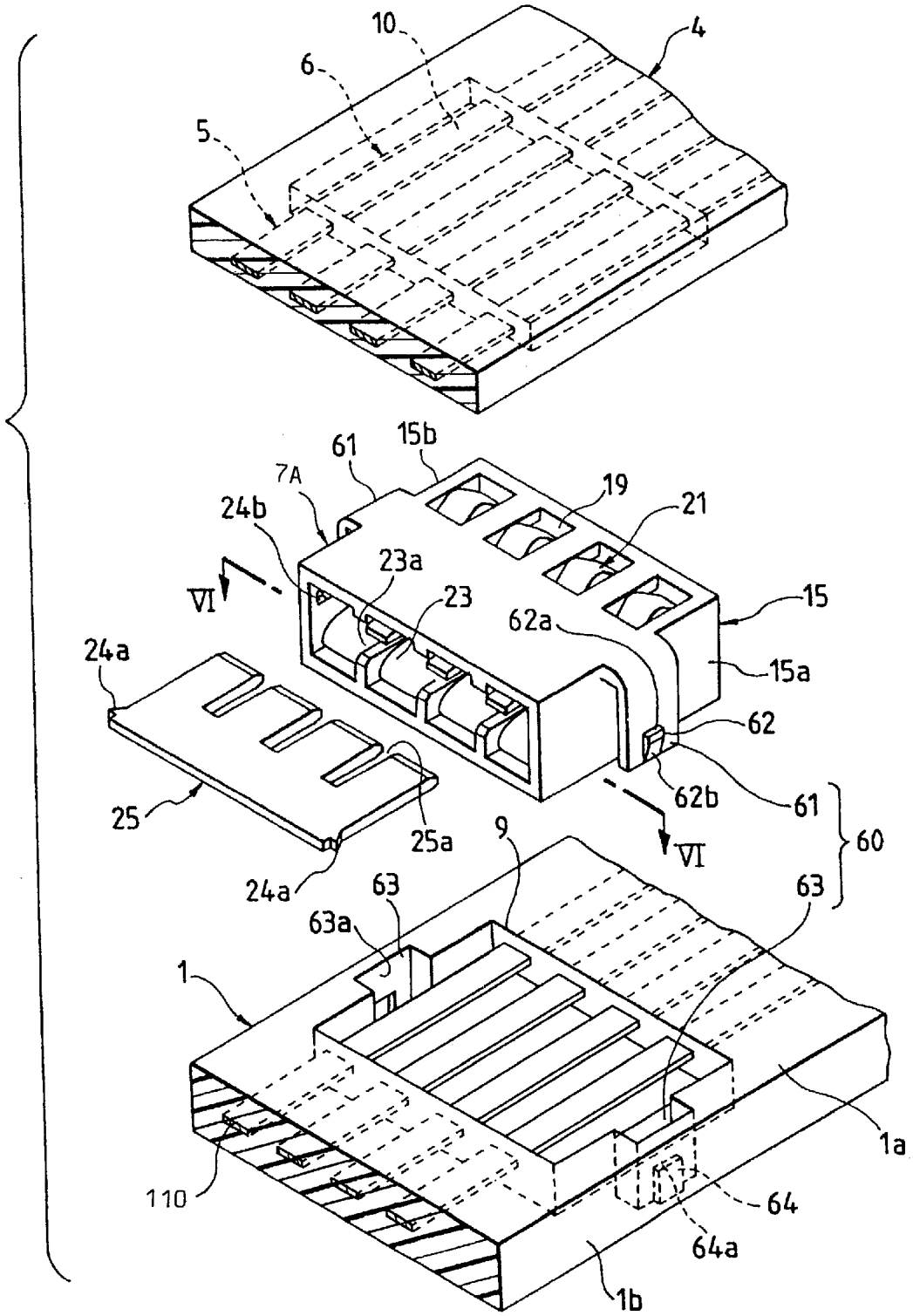
FIG. 16 is an exploded, perspective view showing retaining mechanism used in FIG. 1A.

Of course, this retaining mechanism can be also applied to the first embodiment, as shown in FIG. 16. As further shown in FIGS. 1 and 5, in the embodiments of the present invention, the connector 7A (7B) is used as a member for dealing with a change of the positions of connection between the first-connection portions 3 (41) and the second connection portions 6, and the present invention is not limited to these embodiments.

As described above, according to the present invention, a first structure such as a panel etc. including a first window, a plurality of first circuit members disposed in the first structure, and having first connection portions exposed at the first window of the first structure, a second structure such as another panel, an auxiliary equipment, etc. including a second window, and a plurality of second circuit members disposed in the second structure, and having second connection portions exposed at the second window of the second structure, are provided. The first connection portions and the second connection portions are electrically connected to each other through a connector which can be changed in arrangement. Therefore, even if there is a change in the arrangement of connection between the first and second connection portions, the connection arrangement of the connector can be easily changed in accordance with this connection arrangement. Therefore, the electrical connection between the first and second connection portions can be made, using only one connector. Therefore, as compared with the related construction in which many types of panels are beforehand prepared so as to meet various connection arrangements, the number of types of panels can be reduced. Therefore, the stock management of the panels is easy.

And besides, the connector can be changed in accordance with the arrangement of connection between the first and second connection portions, the cost, involved in the connecting operation, can be reduced.

According to the present invention, the connector can be retained on (fixed to) the first connection portions by the retaining mechanism, and therefore the panel can be moved without the possibility of disengagement of the connector from the first connection portions. Therefore, the operation for connecting the first and second circuit members together can be carried out rapidly.

And besides, since the connector is fixed to one side of the panel by the retaining mechanism, and therefore even if the panel is turned over, the connector will not be disengaged from the panel. Therefore, the other side of the panel in a turned-cover condition can be effectively utilized.

According to the present invention, the terminal receiving chambers are formed in the housing body, and the terminals are inserted in the terminal receiving chambers. The positions of insertion of the terminals in the terminal receiving chambers can be changed. Therefore, the terminals can be inserted respectively in some of the terminal receiving chambers while the other terminal receiving chambers are kept empty, and therefore by selectively inserting the terminals in the terminal receiving chambers, many kinds of connectors can be provided using one housing body. Therefore, the desired connector can be provided in accordance with the arrangement of connection between the first and second connection portions.

According to the present invention, the retaining lances are provided in the terminal receiving chambers in a substantially comb-like fashion, wherein the terminals are respectively retained by the retaining lances.

According to the present invention, the retaining mechanism includes the upstanding lock arm, which is formed on the housing body, the lock projection formed on the free end of the lock arm, the arm groove which is formed in the peripheral portion of the panel-side window so as to receive the lock arm, and the retaining groove for the lock projection. Therefore, the lock arm can be received in the arm groove while utilizing the elasticity of the lock arm, and the lock projection can be engaged in the retaining groove by utilizing the elastic restoration of the lock arm. The lock arm, when elastically restored, vigorously strikes against the bottom surface of the arm groove, and therefore this engaging operation is easy.

According to the present invention, the terminals include at least one first relay terminal which has a base plate portion, and first and second resilient contact portions which are extended respectively from opposite ends of the base plate portion, wherein length of the base plate portion is so designed that the first resilient contact portion is electrically connected to corresponding one of the first connection portions, and the second resilient contact portion is electrically connected to corresponding one of the second connection portions. The first relay terminal has a substantially S-shaped cross-section. The first and second resilient contact portions are connected to the first and second connection portions respectively through the first and second terminal holes. Therefore, the distance between the first and second resilient contact portions can be increased and decreased by changing the length of the base plate portion. Therefore, the position of the first resilient contact portion relative to the first connection portion, as well as the position of the second resilient contact portion relative to the second connection portion, can be adjusted. Therefore, the first and second resilient contact portions can be easily and positively arranged in accordance with the arrangement of connection between the first and second connection portions.

According to the present invention, the terminals include at least one second relay terminal which has a base plate portion, a pair of resilient holding portions extended from one of opposite sides of the base plate portion, and a resilient contact portion extended from the other one of the opposite sides of the base plate portion. The resilient holding portions and the resilient contact portion may be arranged in accordance with the arrangement of connection between the first and second connection portions.

According to the present invention, the terminals include at least one third relay terminal which has a base plate portion, an interconnecting plate portion having an L-shape, the interconnecting plate portion being extended from one end of the base plate portion, and cooperating with the base plate portion to form a U-shape, a resilient contact portion extended from one of opposite sides of the base plate portion, the resilient contact portion having one of the second contact portions, and a pair of resilient holding portions extended from one of opposite sides of the interconnecting plate portion, the pair of resilient holding portions having one of the first contact portions, wherein length of at least one of the base plate portion and the interconnecting plate portion is so designed that the resilient contact portion is electrically connected to corresponding one of the second connection portions, and the pair of resilient holding portions are electrically connected to corresponding one of the first connection portions. The resilient contact portion is formed on the base plate portion while the resilient holding portions are formed on the interconnecting plate portion, and therefore the resilient contact portion is not opposed to the resilient holding portions through each plate portion. Therefore, the resilient contact portion and the resilient holding portions can be disposed in different terminal receiving chambers, respectively. Therefore, in the third relay terminal, the positions of the resilient contact portion and resilient holding portions can be changed in directions parallel and perpendicular to the direction of insertion of the terminal into the terminal receiving chamber.

According to the present invention, the interconnecting plate portion has a transverse plate disposed perpendicular to the base plate portion, and a longitudinal plate disposed in parallel to the base plate portion, and the transverse and longitudinal plates are so designed that a position of insertion of the third relay terminal relative to the terminal receiving chamber can be changed.

According to the present invention, a combination of the second and third relay terminals can be inserted in the terminal receiving chambers, and therefore the relay terminals can be easily arranged in accordance with the arrangement of connection between the first and second connection portions.

According to the present invention, the retaining lances are provided in the terminal receiving chambers in a substantially comb-like fashion, the retaining lances including short lances and a long lance, wherein the base plate portion and the longitudinal plate of the third relay terminal are retained by the short lances, and the transverse plate is retained by the long lance.

What is claimed is:

1. An electrical connection structure, comprising:

a first panel structure having a first window;

a plurality of first circuit members disposed in the first panel structure, the first circuit members having first connection portions exposed a the first window of the first panel structure;

a second panel structure having a second window;

a plurality of second circuit member disposed in the second panel structure, the second circuit members having second connection portion exposed at the second window of the second panel structure;

wherein arrangements of the first connection portions are substantially the same as arrangements of the second connection portions; and a connector including a plurality of terminals that electrically connect the first connection portions with the second connection portions, respectively, and have first contact portions and second contact portions, the connector further including:

a housing body having first and second side walls opposed to each other, the first side wall having first terminal holes formed therein, and the second side wall having second terminal holes formed therein, and a plurality of terminal receiving chambers into which the terminals are respectively inserted, formed in the housing body, the terminal receiving chambers communicating with the first terminal holes and the second terminal holes, respectively, wherein the first contact portions of the terminals are respectively received in the first terminal holes, and the second contact portions of the terminals are respectively received in the second terminal holes, wherein the first contact portions disposed substantially at first ends of the terminals are arranged corresponding to the arrangements of the first connection portions, and electrically connected to the first connection portions, respectively, and the second contact portions disposed substantially at second ends of the terminals are arranged correspondingly to the arrangements of the second connection portions, and electrically connected to the second connection portions, respectively; and a retaining mechanism, wherein the connector is retained on the first panel structure by the retaining mechanism, the retaining mechanism including an upstanding lock arm formed on at least one of opposite side walls of the housing body, and extending toward the first panel structure.

2. The connection structure of claim 1, wherein the first structure includes a first window, the first connection portions are exposed at the first window of the first structure, and the second structure includes a second window, the second connection portions are exposed at the second window of the second structure.

3. The electrical connection structure of claim 1, wherein the first terminal holes are so arranged that the arrangements of the first contact portions of the terminals correspond to the arrangements of the first connection portions, and the second terminal holes are so arranged that the arrangements of the second contact portions of the terminals correspond to the arrangements of the second connection portions.

4. The electrical connection structure of claim 3, further comprising retaining lances provided in the terminal receiving chambers in a substantially comb-like fashion, wherein the terminals are respectively retained by the retaining lances.

5. The electrical connection structure of claim 3, wherein the first and second contact portions are electrically connected to the first and second connection portions respectively through the first and second terminal holes.

6. The electrical connection structure of claim 1, wherein the retaining mechanism includes:

a lock projection formed on a free end of the lock arm;

an arm groove formed in a peripheral portion of the first window so as to receive the lock arm; and a retaining groove which is formed in a surface of the arm groove so as to engage the lock projection.

7. The electrical connection structure of claim 1, wherein the terminals include at least one first relay terminal which has:

a base plate portion; and first and second resilient contact portions which are extended respectively from opposite ends of the base plate portion, the first resilient contact portion has one of the first contact portions, and the second resilient contact portion has one of the second contact portions, wherein the terminals can have different base plate portion lengths so that the first resilient contact portion is electrically connected to corresponding one of the first connection portions, and the second resilient contact portion is electrically connected to corresponding one of the second connection portions.

8. The electrical connection structure of claim 7, wherein the first relay terminal has a substantially S-shaped cross-section.

9. An electrical connection structure, comprising:

a first panel structure;

a plurality of first circuit members disposed in the first panel structure, the first circuit members having first connection portions exposed from the first panel structure;

a second panel structure;

a plurality of second circuit members disposed in the second panel structure, the second circuit members having second connection portions exposed from the second panel structure, wherein arrangements of the first connection portions are substantially the same as arrangements of the second connection portions; and a connector including:

a plurality of terminals that electrically connect the first connection portions with the second connection portions, respectively, and have first contact portions and second contact portions disposed substantially at each end of the terminals, wherein the first contact portions of the terminals are arranged correspondingly to the arrangements of the first connection portions, and electrically connected to the first connection portions, respectively, and the second contact portions of the terminals are arranged correspondingly to the arrangements of the second connection portions, and electrically connected to the second connection portions, respectively;

a housing body having first and second side walls opposed to each other, the first side wall having first terminal holes formed therein, wherein the first terminal holes are so arranged that the arrangements of the first contact portions of the terminals correspond to the arrangements of the first connection portions, and the second side wall having second terminal holes formed therein, and the second terminal holes are so arranged that the arrangements of the second contact portions of the terminals correspond to the arrangements of the second connection portions; and a plurality of terminal receiving chambers into which the terminals are respectively inserted, formed in the housing body, the terminal receiving chambers communicating with the first terminal holes and the second terminal holes, respectively, wherein retaining lances are provided in the terminal receiving chambers in a substantially comb-like fashion, wherein the terminals are respectively retained by the retaining lances, and wherein the first contact portions of the terminals are respectively received in the first terminal holes, and the second contact portions of the terminals are respectively received in the second terminal holes.

* * * * *